US005193704A

United States Patent [19]

Kick

[11] Patent Number: 5,193,704

[45] Date of Patent: Mar. 16, 1993

[54] END CLOSURE ASSEMBLY

[76] Inventor: James Kick, 210 Aspen Village, Ellisville, Mo. 63021

[21] Appl. No.: 800,258

[22] Filed: Nov. 29, 1991

[51] Int. Cl.[5] ..... B65D 51/18

[52] U.S. Cl. ..... 220/253; 220/258; 220/336; 222/480; 222/541

[58] Field of Search ..... 220/253, 256, 258, 266, 220/336, 259, 268; 222/153, 480, 541, 548

[56] References Cited

U.S. PATENT DOCUMENTS

| | | | |
|---|---|---|---|
| 3,486,665 | 12/1969 | LaCroce . | |
| 4,274,563 | 6/1981 | Otterson . | |
| 4,308,979 | 1/1982 | Otterson . | |
| 4,500,016 | 2/1985 | Funfstuck . | |
| 4,541,541 | 9/1985 | Hickman et al. . | |
| 4,572,376 | 2/1986 | Wrennall | 206/538 |
| 4,611,725 | 9/1986 | Kacalieff | 220/253 |
| 4,756,434 | 7/1988 | Frank | 215/201 |
| 4,792,054 | 12/1988 | Weidman | 222/23 |
| 4,846,374 | 7/1989 | Gabrys . | |
| 4,969,572 | 11/1990 | vanKerkhoven . | |

FOREIGN PATENT DOCUMENTS

| | | | |
|---|---|---|---|
| 248645 | 10/1962 | Australia | 220/253 |

*Primary Examiner*—Allan N. Shoap
*Assistant Examiner*—Nova Stucker
*Attorney, Agent, or Firm*—Polster, Lieder, Woodruff & Lucchesi

[57] ABSTRACT

An end closure assembly for a dispensing container and the method of assembly. A cover mounted on the container includes a central opening and a radially spaced dispensing passageway. A rotor overlies the cover and is rotatable about a central, generally columnar, hub positioned within a central orifice of the rotor such that a dispensing passageway through the rotor can be rotated into and out of registry with the cover dispensing passageway to thereby open and close the container. The hub includes an annular, radially outward extending flange which overlies the rotor and holds the rotor against the cover. An annular gripping lip integral with the cover permits downward insertion of the hub into the cover orifice during assembly yet inhibits removal of the hub after assembly. If the assembly is tampered with by attempting to remove the hub from the cover orifice or by removing the rotor from beneath the hub flange, it will be difficult to replace the rotor or hub without the assembly showing evidence of the tampering. An efficient method of assembling the end closure includes forming the rotor and hub as a one piece article of manufacture connected by bridging material which breaks and separates the rotor and hub during assembly. The method is not only more economical but also allows a design formed into the rotor and hub to be in proper alignment immediately after assembly.

12 Claims, 2 Drawing Sheets

END CLOSURE ASSEMBLY

BACKGROUND OF THE INVENTION

The invention relates to end closure assemblies for a dispensing container of the type having a cover on the container including a cover dispensing passageway therethrough and an overlying rotor which is rotatable with respect to the cover. The rotor includes at least one rotor dispensing passageway therethrough which, when the rotor is selectively rotated, may be brought into registry with the cover dispensing passageway to permit access to the contents of the container, or out of registry to close the container. Such end closure assemblies are commonly used on canister type containers for dispensing powdered or granular food products such as grated cheese, powdered coffee creamer, spices and other condiments. One such prior art end closure is shown in U.S. Pat. No. 4,308,979.

In recent years, it has become more important to container manufacturers to provide containers, and especially container closures, which are safe, more tamper resistant, and help shopkeepers and consumers determine if the container has been tampered with to alert them to the possibility that the contents may have been adulterated.

One such tamper resistant end closure assembly is shown in U.S. Pat. No. 4,541,541. This patent shows the utilization of frangible plastic points molded into the rotor which are designed to break in the event of tampering. However, some drawbacks exist with this scheme. In the event one is able to remove the top rotor without breaking the frangible areas, the container contents are freely accessible and the rotor can easily be snapped back onto the cover plate without any evidence that the container had been tampered with. Further, if a logo or other design is to be molded into the top of the rotor it could interfere with the proper operation of the frangible areas.

Another tamper resistant end closure is disclosed in U.S. Pat. No. 4,846,374. This scheme provides for a hollow stem hub which is inserted into a hole in the cover and thereafter a plug in driven into and bonded with the stem. This assembly is difficult and relatively expensive to accomplish on a fast moving assembly line and also suffers from the same draw back mentioned above in that if the rotor is successfully removed, access to the contents is gained and the rotor could then be snapped back onto the cover.

SUMMARY OF THE INVENTION

It is therefore an object of the present invention to provide a tamper resistant end closure assembly which is relatively inexpensive to produce and assembly.

It is another object of the invention to provide a closure assembly which does not permit free access to the contents of a container even after the rotor has been removed from the assembly and which will likely show evidence of tampering should it be attempted to replace the rotor on the container.

It is a further object of the invention to provide an article of manufacture which initially combines the hub and rotor into one molded piece thus allowing quicker and less expensive assembly and permitting automatic initial proper alignment between design areas of the hub and rotor molded into the article.

It is a still further object of the invention to provide an improved method of assembling a tamper resistant end closure for a container.

Generally speaking, one aspect of the invention resides in an end closure assembly for a container and having a cover dispensing passageway therethrough. A rotor mounted over the cover for relative rotational movement therebetween about a pivot axis. The rotor has at least one dispensing passageway which is radially offset from the pivot axis and which may be brought into and out of registry with the cover dispensing passageway upon selective relative rotation between the cover and the rotor. A hub carried by the cover includes flange means extending radially outward with respect to the pivot axis. The rotor includes an orifice through which the hub extends with the flange means overlying the rotor. When the assembly is tampered with and the rotor is at least partially pryed from beneath the hub flange means, it will be difficult to replace the rotor under the flange means without leaving deformations, cuts, or other signs that the assembly has been tampered with. Also removal of the hub in order to gain access to the contents of the container, would be difficult without permanent deformation of the hub flange means or cover.

Another aspect of the invention is an article of manufacture comprising the rotor and hub which can be used to more economically assemble the end closure. The article includes a plastic circular rotor member including a central circular opening and a hub member molded with the rotor and positioned within the opening and held in place by plastic bridge means of reduced thickness which will break during assembly to permit the rotor and hub to be assembled with a single downward stroke and in a position which ensures alignment of a design molded into the hub and rotor.

A third aspect of the invention is the unique method which may be used to assemble an end closure including the steps of forming a rotor and hub initially attached; placing the hub into an orifice of a cover; applying a downward force on the hub to force the hub into the orifice and to simultaneously force the rotor into overlying contact with the cover; continuing to apply downward force on the hub to break the bridging material and further force the hub into the orifice; and engaging a radially outward extending flange means on the hub with the rotor.

Additional objects and advantages of the present invention will become more apparent upon a reading of the following description of the preferred embodiments in conjunction with the drawings wherein:

DESCRIPTION OF THE PREFERRED EMBODIMENTS

Figure 1:
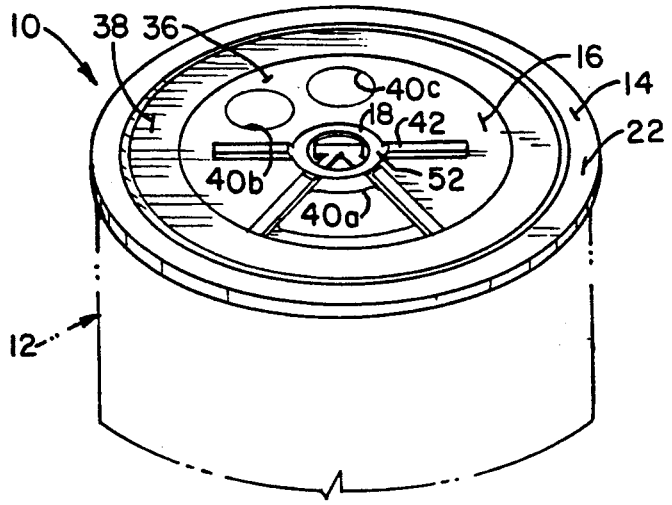
FIG. 1 is a perspective view of an end closure assembly constructed in accordance with the principles of the present invention with the top end of a container on which the closure assembly is to be mounted shown in phantom line.
Figure 2:
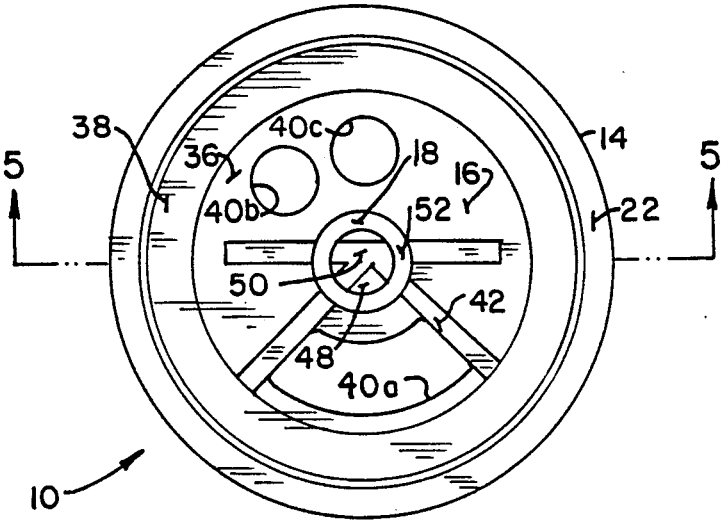
FIG. 2 is a top plan view of the end closure assembly.

Referring now to the drawings, and FIGS. 1 and 2 in particular, there is shown one preferred form of an end closure assembly constructed in accordance with the principles of the present invention and generally referred to by reference numeral 10. Assembly 10 is shown in FIG. 1 as it might be mounted on an end of a canister type container 12, the top portion only of which is shown in the drawing in phantom line.

End closure assembly 10 is comprised of a generally planar, circular cover 14, a generally planar, circular rotor 16, and a generally cylindrical or columnar hub 18.

Figure 5:
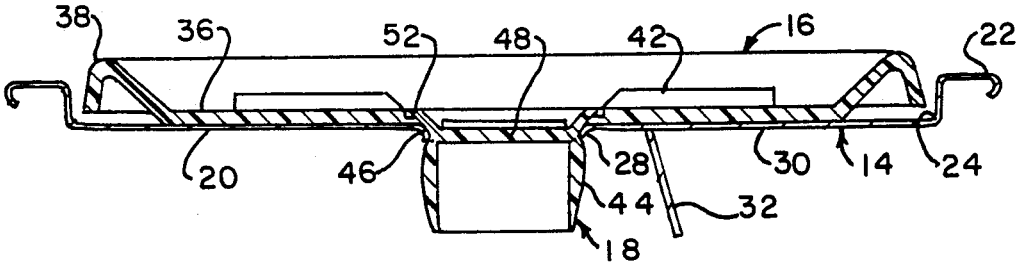
FIG. 5 is an enlarged cross section of the assembly similar to FIG. 4 showing the finished assembly.

Circular cover 14 is preferably formed from thin sheet metal stock but may be fabricated of molded plastic. Cover 14 includes a circular central body portion 20 and an annular rim portion 22 which is raised above body portion 20 thereby creating with body portion 20 a shallow circular cavity 24. Rim portion 22 is formed to engage the cylindrical side wall of canister 12 and may be crimped and/or glued to the wall to form an annularly sealed end cover for canister 12. Cover 14 also includes a centrally located orifice 26 defined by a downwardly and slightly radially inwardly directed annular lip 28. Cover 14 is also provided with a dispensing passageway 30 which is initially closed by a lid portion 32 of the metal body portion 20 and which is defined by scored lines around the periphery thereof, which lines are frangible around at least a major portion thereof. Thus, downward pressure on lid portion 32 will break the frangible peripheral lines and cause the remainder of the scored line to bend downwardly into container 12 to thereby open dispensing passageway 30. It is noted that lid portion 32 is represented in the open position in FIG. 5 only. It is also noted that other similar constructions for lid openings are known for plastic as well as metal container covers and the dispensing passageway lid construction described herein is only one preferred construction.

Rotor 16 is preferably formed of plastic and includes a central circular orifice 34, a generally planar, circular body portion 36 and a raised circumferential rim portion 38. Body portion 36 of rotor 16 is provided with at least one, and preferably three, dispensing passageways 40*a*, 40*b*, 40*c* positioned such that selective rotation of rotor 16 with respect to cover 14 will bring all or a portion of passageway 40*a* into registry with cover dispensing passageway 30, bring passageway 40*c* only or bring passageways 40*c* and 40*b* into registry with passageway 30 to provide a desired area of container opening. Rotor 16 is also provided with integrally molded upwardly extending handle portions 42 which may be located on rotor 16 to form a design or logo such as the K shown in FIGS. 1 and 2.

Figure 3:
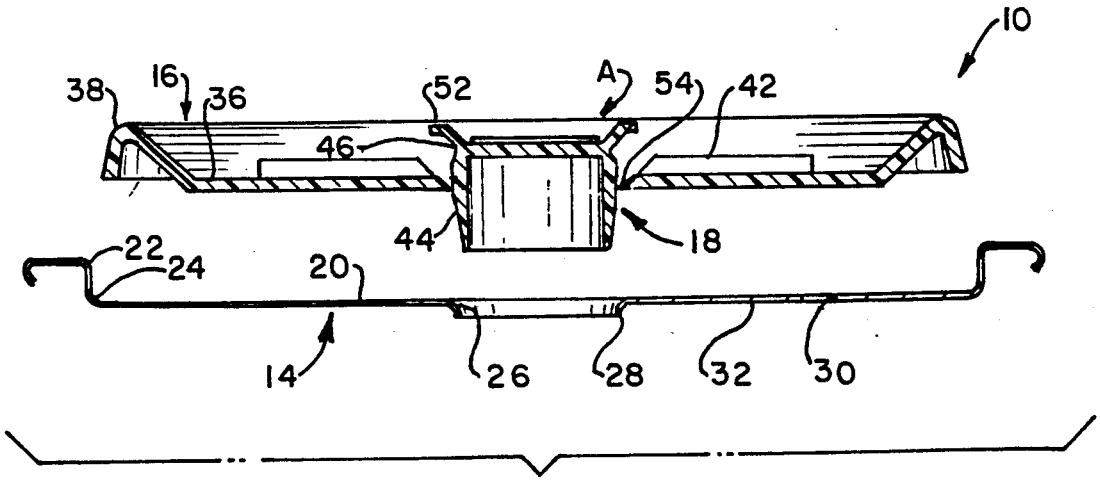
FIG. 3 is an enlarged exploded cross section of the preferred embodiment of the assembly taken generally along reference line 5—5 of FIG. 2.
Figure 3A:
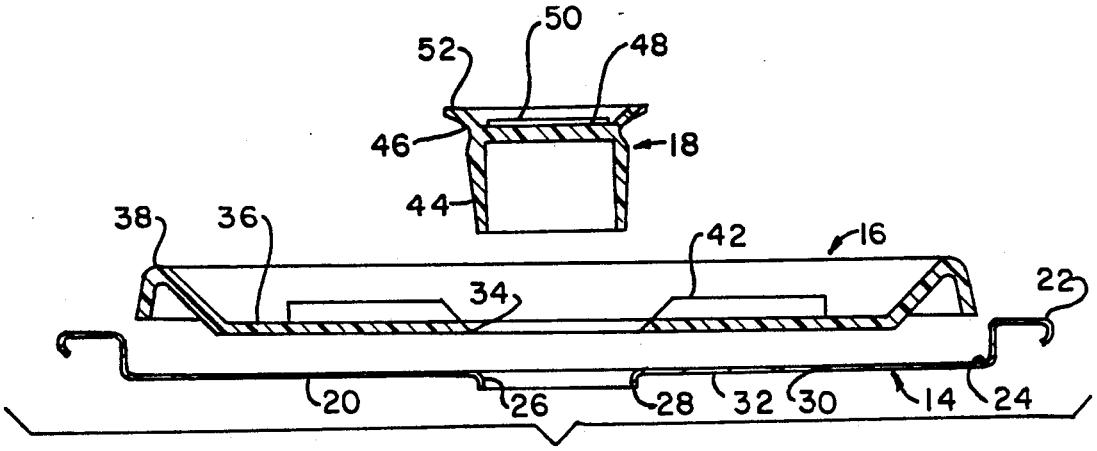
FIG. 3A is an enlarged exploded cross section of another embodiment of the assembly also generally taken along reference line 5—5 of FIG. 2.

Hub 18 is preferably formed of the same plastic material as rotor 16, and is in fact preferably formed with rotor 16 as a one piece article of manufacture A as shown in FIG. 3. It is noted however that hub 18 and rotor 16 could be manufactured as two separate members as depicted in FIG. 3A.

Hub 18 includes a hollow, generally cylindrical body portion 44 having an outside diameter at the lowest point thereof equal to or slightly less than the diameter of orifice 26 defined by lip 28. The outside diameter of body portion 44 gradually increases in the upward direction whereafter the outside diameter quickly reduces to a neck portion 46 of hub 18. Neck portion 46 is sized to snugly fit within lip 28. At the horizontal plane of neck portion 46 hub 18 is provided with horizontal wall 48 which blocks access through hub 18. Wall 48 may contain on the upper surface thereof a raised design 50 which when viewed with raised design 42 on rotor 16 may cooperate to complete an overall design such as the K best seen in FIG. 2. Hub 18 also is provided with radially outward extending annular flange 52 projecting from neck portion 46.

As shown in FIG. 3, it is preferred to form rotor 16 and hub 18 as a one-piece molded plastic article of manufacture A. In this case, hub body portion 44 is connected at an approximate vertical midpoint thereof to the wall defining opening 34 by an annular thin bridge of plastic material 54 which can easily be made to break separating hub 18 from rotor 16 upon the application of a downward force on hub 18 relative to rotor 16. The plastic bridge may be in the form of a perforated circumferential line and is considerably thinner than the thickness of rotor 16. This feature is important in that is helps facilitate the assembly process making assembly more economical, provides a more economical means of molding the hub and rotor, and permits the raised design areas 50 and 42 of the hub and rotor, respectively, to be aligned upon assembly.

Figure 4:
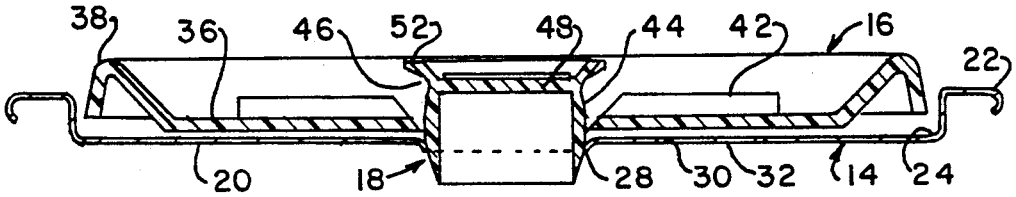
FIG. 4 is an enlarged cross section of the assembly similar to FIGS. 3 and 3A except showing an intermediate position of the component parts during assembly.

During assembly of end closure 10, article A containing integrally molded rotor 16 and hub 18 is brought into coaxial alignment with cover 14. Downwardly directed pressure on hub 18 will initially insert the lower extremity of body portion 4 of hub 18 into orifice 26 defined by depending lip 28 (FIG. 4). As hub 18 is forced into orifice 26 it must compress radially inwardly to accommodate the enlarged diameter of the midsection of body portion 44. As cover 14 is stationery, continued downward force on hub 18 will bring rotor 16 into contact with cover 14; thereafter the bridge material 54 connecting rotor 16 with hub 18 will break allowing hub 18 to continue down into orifice 26. When reduced diameter neck portion 46 reaches the plane of cover 14, body portion 44 will expand to its original larger diameter size and flange 52 will abut rotor 16 to hold body portion 36 of rotor 16 in overlying contact with body portion 20 of cover 14. Also, preferably the molded configuration of flange 52 is such that flange 52 will be urged slightly upwardly by the thickness or rotor 16 after assembly. It can thus be seen that according to the finished assembly shown in FIG. 5, rotor 16 captured by flange 52 of hub 18 may rotate about the pivot axis of openings 34 and 26 while held in sliding contact with cover 14. Also downwardly directed lip 28 on cover 16 will engage the enlarged diameter body potion 44 of hub 18 to hold hub 18 in proper position with respect to cover 14. Alteration of the dimensional tolerances between cover 14, rotor 16 and hub 18 will determine whether the hub and rotor rotate together with respect to cover 14, or whether the rotor rotates with respect to the cover and hub. In the former case, the design 42,50 will always be aligned. In the latter, the design will be aligned only initially, prior to use.

Figure 6:
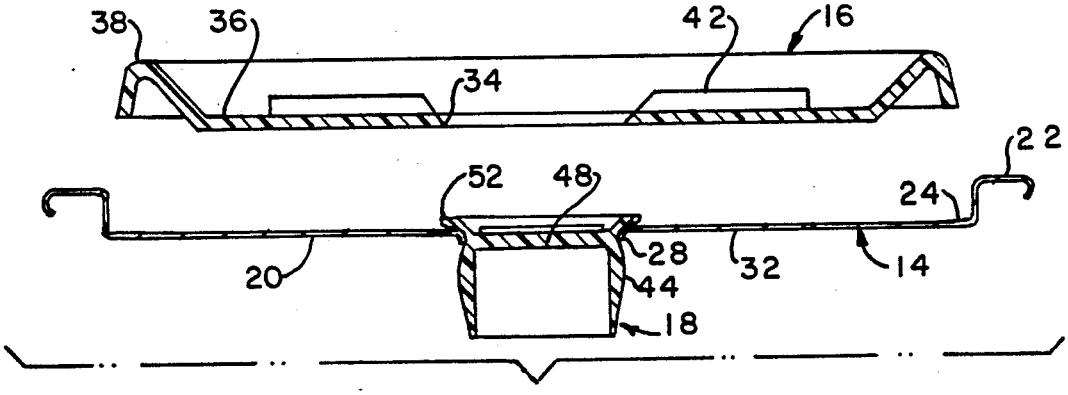
FIG. 6 is an enlarged cross section showing the position of the hub with respect to the cover after the rotor has been tampered with and removed.

FIG. 6 depicts the tamper resistant features of the present invention. Prior to opening dispensing passageway 30 in cover 14 as would be the case on the retail shelf, if someone should attempt to pry off rotor 16, the rotor will pull up from beneath flange 52 of hub 18, since a prying force on the outer edge of the rotor could not overcome the gripping connection of lip 28 holding hub 18 in cover orifice 26. If rotor 16 is successfully removed from beneath hub flange portion 52, the container will remain completely closed lessening the chance that the contents thereof could be adulterated. If it is attempted to pull up on and remove hub 18, the firm engagement of downwardly directed lip with hub body portion 44 will prevent removal and instead cover 14 would most likely become irrepairably deformed. Also, when rotor 16 is removed from beneath flange 52 of hub 18, the flange may resume its manufactured shape and contract downwardly into contact with cover 14, and it would be very difficult to replace rotor 16 into its original position without leaving some visual signs of tampering such as cuts, gouges and other deformations in the hub or rotor.

It can thus be seen that the above described preferred embodiments of the present invention fulfill the objects and provide the advantages set forth hereinabove. Inasmuch as numerous changes and modifications may be made to the preferred embodiments without departing from the spirit and scope thereof, e.g., cover orifice lip 28 may be formed of a plurality of circumferentially spaced fingers, the scope of the invention is to be determined solely by the language of the following claims taking into consideration the doctrine of equivalents.

What is claimed is:

1. An end closure assembly for a container comprising:

a cover mountable on a container and having a cover dispensing passageway therethrough;

a rotor mounted over said cover for relative rotational movement therebetween about a pivot axis, said rotor having at least one rotor dispensing passageway therethrough which is radially spaced from said pivot axis and which may be brought into and out of registry with said cover dispensing passageway upon selective relative rotation between said cover and said rotor;

a hub separate from said cover for pivotally mounting said rotor on said cover, said hub including flange means extending radially outward with respect to said pivot axis, said flange means being circumferentially continuous and terminating in the radial outward direction short of said rotor dispensing passageway;

said rotor including an orifice, said hub extending through said orifice with said flange means overlying said rotor;

whereby when said assembly is tampered with and said rotor is at least partially pried form beneath said flange means, it will be difficult to replace said rotor to the position beneath said flange means without the assembly showing evidence of tempering.

2. The end closure assembly as specified in claim 1 and further comprising:

said cover including an orifice and said hub extending through and being captured within said orifice; and said hub blocking access into the container through said orifice.

3. The end closure assembly as specified in claim 2 and further comprising:

said hub including a neck portion located beneath said flange means and a body portion located beneath said neck portion;

said body portion being generally columnar and tapered downwardly such that said body portion may be initially inserted into said orifice from above and thereafter radially compressed as said hub is pushed into said orifice until said neck portion reaches the plane of said cover;

whereby removal of said hub from said orifice from above is hindered by obstruction of said body portion with said cover.

4. The end closure assembly as specified in claim 3 and further comprising;

said cover defining said orifice with downwardly depending lip means for engaging and holding said body portion of said hub in the event an attempt is made to remove said hub from said orifice from above.

5. The end closure assembly as specified in claim 1 wherein:

said cover is fabricated of metal and said rotor is fabricated of plastic.

6. The end closure assembly as specified in claim 5 wherein:

said hub is fabricated of plastic.

7. The end closure assembly as specified in claim 1 wherein:

said cover dispensing passageway initially being closed by a lid portion which is at least partially removable from said cover.

8. The end closure assembly as specified in claim 1 and further comprising:

said flange means overlying said rotor 360 degrees around said pivot axis.

9. An article of manufacture adapted to be used in the assembly of a container end closure comprising:

a plastic circular rotor member including a central circular opening and a hub member molded with said rotor member and positioned within said opening;

said hub being held in place with respect to said rotor by plastic bridge means of reduced thickness relative to said rotor;

said hub including flange means at a top end thereof extending radially outwardly with respect to said opening and said flange means being longitudinally spaced above said bridge means, and said hub at a bottom end thereof having a reduced radius relative to said flange means;

whereby, as a downward force is applied to said hub relative to said rotor, said plastic bridge means will break permitting said hub to move through said central opening until said flange means abuts said rotor.

10. The article as specified in claim 9 and further comprising:

said hub including an annular neck portion beneath said flange means and a body portion beneath said neck portion;

said body portion being circular in horizontal cross section and having an outer diameter greater than the diameter of said neck portion; and said flange means extending radially outward beyond said body portion.

11. The article as specified in claim 9 and further comprising:

design means molded into the upper surfaces of said rotor and said hub such that said bridge means holds said design means in alignment and when said force is applied said design means will remain aligned.

12. The article as specified in claim 9 and further comprising:

at least one dispensing passageway through said rotor radially spaced from said central opening.

* * * * *